US006769933B2

(12) United States Patent
Bence et al.

(10) Patent No.: US 6,769,933 B2
(45) Date of Patent: Aug. 3, 2004

(54) COAXIAL CABLE CONNECTOR AND RELATED METHODS

(75) Inventors: Bruce D. Bence, Glendale, AZ (US); Edward M. Penunuri, Glendale, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 10/308,989

(22) Filed: Nov. 27, 2002

(65) Prior Publication Data

US 2004/0102088 A1 May 27, 2004

(51) Int. Cl.[7] ..... H01R 9/05
(52) U.S. Cl. ..... 439/578; 439/584
(58) Field of Search ..... 439/578, 583, 439/584, 585

(56) References Cited

U.S. PATENT DOCUMENTS

| | | | | |
|---|---|---|---|---|
| 3,778,535 A | | 12/1973 | Forney, Jr. | 174/88 C |
| 3,920,304 A | | 11/1975 | Bromberg | 339/94 M |
| 3,982,060 A | | 9/1976 | Avery et al. | 174/75 C |
| 4,168,921 A | | 9/1979 | Blanchard | 403/19 |
| 4,346,958 A | | 8/1982 | Blanchard | 339/177 R |
| 4,368,940 A | | 1/1983 | Sugiura | 339/177 E |
| 4,468,080 A | | 8/1984 | VanBrunt | 339/136 R |
| 4,596,434 A | | 6/1986 | Saba et al. | 339/177 R |
| 4,645,281 A | | 2/1987 | Burger | 339/37 |
| 4,660,921 A | | 4/1987 | Hauver | 339/177 R |
| 4,676,577 A | | 6/1987 | Szegda | 439/584 |
| 4,688,876 A | * | 8/1987 | Morelli | 439/578 |
| 4,834,675 A | | 5/1989 | Samchisen | 439/578 |
| 4,869,679 A | | 9/1989 | Szegda | 439/272 |
| 4,902,246 A | | 2/1990 | Samchisen | 439/578 |
| 4,969,845 A | | 11/1990 | Hauchard et al. | 439/750 |
| 4,990,106 A | | 2/1991 | Szegda | 439/585 |
| 5,024,606 A | | 6/1991 | Ming-Hwa | 439/578 |
| 5,066,248 A | | 11/1991 | Gaver, Jr. et al. | 439/578 |
| 5,073,129 A | | 12/1991 | Szegda | 439/585 |
| 5,181,861 A | | 1/1993 | Gaver, Jr. et al. | 439/578 |
| 5,195,906 A | | 3/1993 | Szegda | 439/394 |
| 5,207,602 A | | 5/1993 | McMills et al. | 439/836 |
| 5,217,393 A | | 6/1993 | Del Negro et al. | 439/585 |
| 5,283,853 A | | 2/1994 | Szegda | 385/139 |
| 5,315,684 A | | 5/1994 | Szegda | 385/139 |
| 5,371,819 A | | 12/1994 | Szegda | 385/75 |
| 5,371,821 A | | 12/1994 | Szegda | 385/87 |
| 5,371,827 A | | 12/1994 | Szegda | 385/136 |
| 5,393,244 A | | 2/1995 | Szegda | 439/394 |
| 5,431,583 A | | 7/1995 | Szegda | 439/589 |
| 5,439,386 A | | 8/1995 | Ellis et al. | 439/322 |

(List continued on next page.)

FOREIGN PATENT DOCUMENTS

| | | |
|---|---|---|
| GB | 2 249 979 | 5/1992 |
| JP | 4-329275 | 11/1992 |
| JP | 6-29062 | 2/1994 |
| JP | 6-29063 | 2/1994 |

OTHER PUBLICATIONS

Micropatent Report for JP 4–329275.
Micropatent Report for JP 6–29062.
Micropatent Report for JP 6–29063.

*Primary Examiner*—Tho D. Ta
(74) *Attorney, Agent, or Firm*—Stephen T. Sullivan; Joseph M. Homa

(57) ABSTRACT

A cable gripping component is provided for gripping a coaxial cable. The cable gripping component includes a housing including a sleeve portion having a terminus forming a first end housing. The housing has an inner surface defining an interior channel. The inner surface includes a retention surface disposed on the sleeve portion proximate the terminus. The sleeve portion includes a weakened area. The retention surface is disposed between the terminus and the weakened area. Related methods are disclosed.

20 Claims, 6 Drawing Sheets

U.S. PATENT DOCUMENTS

| | | | | |
|---|---|---|---|---|
| 5,444,810 | A | | 8/1995 | Szegda ..... 385/139 |
| 5,456,614 | A | | 10/1995 | Szegda ..... 439/321 |
| 5,461,688 | A | | 10/1995 | Lee ..... 385/75 |
| 5,470,257 | A | | 11/1995 | Szegda ..... 439/578 |
| 5,501,616 | A | | 3/1996 | Holliday ..... 439/585 |
| 5,508,475 | A | | 4/1996 | Profiri et al. ..... 174/74 R |
| 5,514,001 | A | | 5/1996 | Szegda ..... 439/263 |
| 5,571,028 | A | | 11/1996 | Szegda ..... 439/322 |
| 5,598,132 | A | | 1/1997 | Stabile ..... 322/22 R |
| 5,632,651 | A | | 5/1997 | Szegda ..... 439/578 |
| 5,651,698 | A | | 7/1997 | Locati et al. ..... 439/578 |
| 5,667,405 | A | | 9/1997 | Holliday ..... 439/585 |
| 5,692,090 | A | | 11/1997 | Szegda ..... 385/139 |
| 5,769,662 | A | | 6/1998 | Stabile et al. ..... 439/578 |
| 5,800,211 | A | | 9/1998 | Stabile et al. ..... 439/578 |
| 5,857,872 | A | | 1/1999 | Tettinger ..... 439/584 |
| 5,863,220 | A | | 1/1999 | Holliday ..... 439/584 |
| 5,938,474 | A | * | 8/1999 | Nelson ..... 439/583 |
| 5,942,730 | A | | 8/1999 | Schwarz et al. ..... 174/84 R |
| 5,975,949 | A | | 11/1999 | Holliday et al. ..... 439/585 |
| 6,017,242 | A | | 1/2000 | Kerrigan ..... 439/445 |
| 6,089,912 | A | | 7/2000 | Tallis et al. ..... 439/584 |
| 6,089,913 | A | | 7/2000 | Holliday ..... 439/584 |
| 6,102,738 | A | * | 8/2000 | Macek et al. ..... 439/584 |
| 6,153,830 | A | | 11/2000 | Montena ..... 174/88 C |
| 6,160,221 | A | | 12/2000 | Hablützel ..... 174/88 C |
| 6,217,384 | B1 | | 4/2001 | Strasser et al. ..... 439/583 |
| 6,386,915 | B1 | | 5/2002 | Nelson ..... 439/584 |
| 6,425,782 | B1 | | 7/2002 | Holland ..... 439/585 |
| 6,530,807 | B2 | * | 3/2003 | Rodrigues et al. ..... 439/578 |

* cited by examiner

COAXIAL CABLE CONNECTOR AND RELATED METHODS

BACKGROUND OF THE INVENTION

1. Field of the Invention

The present invention relates to connectors for coaxial cables and related components and methods, including, for example, rigid coaxial cables such as those used for trunk and distribution lines in such applications as cable television and the like, and related components and methods.

2. Description of the Related Art

Of the various coaxial cable designs, each has shared elements, e.g., including an inner or center conductor surrounded by an insulating material, typically referred to as the core, and an outer conductor surrounding the insulating layer. In some coaxial cables, such as with flexible coaxial cables, the outer conductor comprises a braided conductive material. These flexible coaxial cables typically include an outer insulator material, sometimes referred to as a jacket, that surrounds and encases the outer conductor. In other coaxial cables, for example, rigid coaxial cable, the outer conductor is a solid, conductive material, and the outer conductor commonly constitutes the exterior of the coaxial cable, without any need for an outer insulator or jacket.

Coaxial cable connectors must firmly and securely connect the coaxial cable to a terminal. Moreover, it is usually desirable, if not necessary, to ensure that the connector provide a seal so as to avoid exposure or contamination of the interior of the connector to moisture, particulate matter, and/or other undesirable material to which portions of the connector and/or cable may be exposed.

One concern with some commercially available connectors is that the tightening of the connector during installation causes an undesirable twisting of the coaxial cable, leading to unwanted stress on the cable that can cause wear and/or malfunctions.

To address these concerns, some connectors include a gripping and/or sealing component, for example, such as a ferrule, to contact and grip the cable at its exterior, whether it be an outer insulator or jacket or an outer conductor in cable designs that exclude the jacket. This ferrule or like component grips the cable exterior so that the cable is firmly secured with respect to the connector, and so that infiltration of environmental substances such as those noted above can be limited or avoided. The gripping component typically is housed within a larger housing component that also forms a part of the connector.

An example of a commercially available connector for connecting a coaxial cable to a terminal is shown in FIG. 11. The connector shown in FIG. 11, generally designated as 200, comprises a back nut assembly 202, a main nut assembly 204, and a body 206. A coaxial cable end (not shown) is inserted into a distal end 210 of connector 200, at a distal portion of back nut 202. A conductive pin 212 extends from a proximal end 214 of connector 200, at a proximal portion of body 206. A ferrule 220 is disposed in the interior of back nut 202. Ferrule 220 contacts the exterior of the coaxial cable. A pair of compression rings 222 and 224 are positioned within back nut 202 at proximal and distal ends of ferrule 220, respectively. The proximal compression ring 222 retains the ferrule 220 in place in the interior of the back nut 202, while the distal compression ring 224 prevents the ferrule 220 from moving distally.

When such a connector is in a disassembled state, for example, as possibly provided when new and ready for use, the gripping component, e.g., the back nut 202, and in some cases the ferrule 220, may be provided as a separate component or components, thereby requiring separate handling, which increases the likelihood of being misplaced or lost. Moreover, during installation the ferrule must be correctly inserted into the housing and retained while the remainder of the connector is installed and tightened in place. Thus, the cable gripping component often is partly or fully responsible for twisting the cable, which can place unwanted stress on the cable and connector through its interaction and cooperation with the associated housing.

OBJECTS OF THE INVENTION

Accordingly, an object of the present invention is to provide a connector and related components and methods that facilitate efficient pre-assembly handling.

Another object of the invention is to provide a connector and related components and methods that limit or prevent unwanted twisting of the cable during installation.

Another object of the invention is to provide a connector and related components and methods that are relatively efficient and cost effective.

Additional objects and advantages of the invention will be set forth in the description which follows, and in part will be apparent from the description, or may be learned by practice of the invention. The objects and advantages of the invention may be realized and obtained by means of the instrumentalities and combinations pointed out in the appended claims.

SUMMARY OF THE INVENTION

To achieve the foregoing objects, and in accordance with the purposes of the invention as embodied and broadly described in this document, a cable gripping component is provided for gripping a coaxial cable. The cable gripping component comprises a housing including a sleeve portion having a terminus forming a first end of the housing. The housing has an inner surface defining an interior channel. The inner surface comprises a retention surface disposed on the sleeve portion proximate the terminus. The sleeve portion includes a weakened area. The retention surface is disposed between the terminus and the weakened area.

The cable gripping component further comprises a ferrule disposed within the interior channel for contacting the coaxial cable. The ferrule comprises an outer surface that includes a raised portion. The interfering engagement between at least a portion of the retention surface and the raised portion prevents at least a portion of the ferrule from exiting the interior channel.

The weakened area may comprise at least one groove, and preferably a plurality of grooves, which preferably is or are disposed on the inner surface of the sleeve portion.

The cable gripping component also preferably comprises a compression ring disposed within the interior channel between the ferrule and the inner surface of the housing. Preferably, the ferrule comprises a beveled mating surface, and the compression ring comprises a beveled mating surface for mating with the beveled mating surface of the ferrule.

The ferrule preferably has a terminus that extends beyond the terminus of the housing. The ferrule also may be loosely held within the interior channel. The ferrule also preferably may be rotatable within the interior channel.

In accordance with another aspect of the invention, a connector is provided for a coaxial cable. The connector comprises a cable gripping component comprising a cable gripping component housing including a sleeve portion having a terminus forming a first end of the housing. The housing has an inner surface defining an interior channel. The inner surface comprises a retention surface disposed on the sleeve portion proximate the terminus. The sleeve portion includes a weakened area. The retention surface is disposed between the terminus and the weakened area.

The connector further comprises a ferrule disposed within the interior channel for contacting the coaxial cable. The ferrule comprises an outer surface that includes a raised portion. Interfering engagement between at least a portion of the retention surface and the raised portion prevents at least a portion of the ferrule from exiting the interior channel.

The connector according to this aspect of the invention also comprises a coupling component attached to the first end of the cable gripping component. Preferably but optionally, the ferrule contacts the coupling component.

The cable gripping component of this connector may further comprise a compression ring disposed within the interior channel between the cable gripping component housing and the ferrule. Preferably, the compression ring does not contact the coupling component. It is preferred that the ferrule and the coupling component have mutually mating beveled surfaces.

In accordance with another aspect of the invention, a method is provided for providing a cable gripping component for a coaxial cable. The method comprises providing a cable gripping component housing including a sleeve portion having a terminus forming a first end of the housing. The housing has an inner surface defining an interior channel, wherein the inner surface comprises a retention surface disposed on the sleeve portion proximate the terminus. The sleeve portion includes a weakened area. The retention surface is disposed between the terminus and the weakened area.

The method also comprises providing a ferrule comprising an outer surface that includes a raised portion, and inserting the ferrule into the interior channel. It further comprises crimping the sleeve portion to provide interfering engagement between at least a portion of the retention surface and the raised portion, whereby at least a portion of the ferrule is prevented from exiting the interior channel. It also may comprise inserting the ferrule into the interior channel so that the ferrule is capable of rotating within the interior channel.

The method in its preferred implementation further comprises providing a coupling component and attaching the coupling component to the first end of the cable gripping component.

In accordance with another aspect of the invention, a method is provided for attaching a connector to a coaxial cable. The method comprises providing a cable gripping component for a coaxial cable, wherein the cable gripping component comprises a cable gripping component housing including a sleeve portion having a terminus forming a first end of the housing. The housing has an inner surface defining an interior channel. The inner surface comprises a retention surface is disposed on the sleeve portion proximate the terminus. The sleeve portion includes a weakened area. The retention surface is disposed between the terminus and the weakened area. In accordance with this method, the cable gripping component further comprises a ferrule disposed in an interior channel of the housing. The ferrule comprises an outer surface that includes a raised portion, wherein the inner surface narrows from the weakened area to the retention area and at least a portion of the ferrule is prevented from exiting the interior channel by the retention surface and the raised portion of the ferrule outer surface.

The method further comprises positioning the cable gripping component on the coaxial cable so that the ferrule contacts the coaxial cable, and providing a coupling component and attaching the coupling component to the first end of the cable gripping component. In its presently preferred implementations, the method comprises providing a compression ring within the cable gripping component to contact the ferrule.

BRIEF DESCRIPTION OF THE DRAWINGS

The accompanying drawings, which are incorporated in and constitute a part of the specification, illustrate presently preferred embodiments and methods of the invention and, together with the general description given above and the detailed description of the preferred embodiments and methods given below, serve to explain the principles of the invention. Of the drawings.

DETAILED DESCRIPTION OF THE PREFERRED EMBODIMENTS AND METHODS

Figure 1:
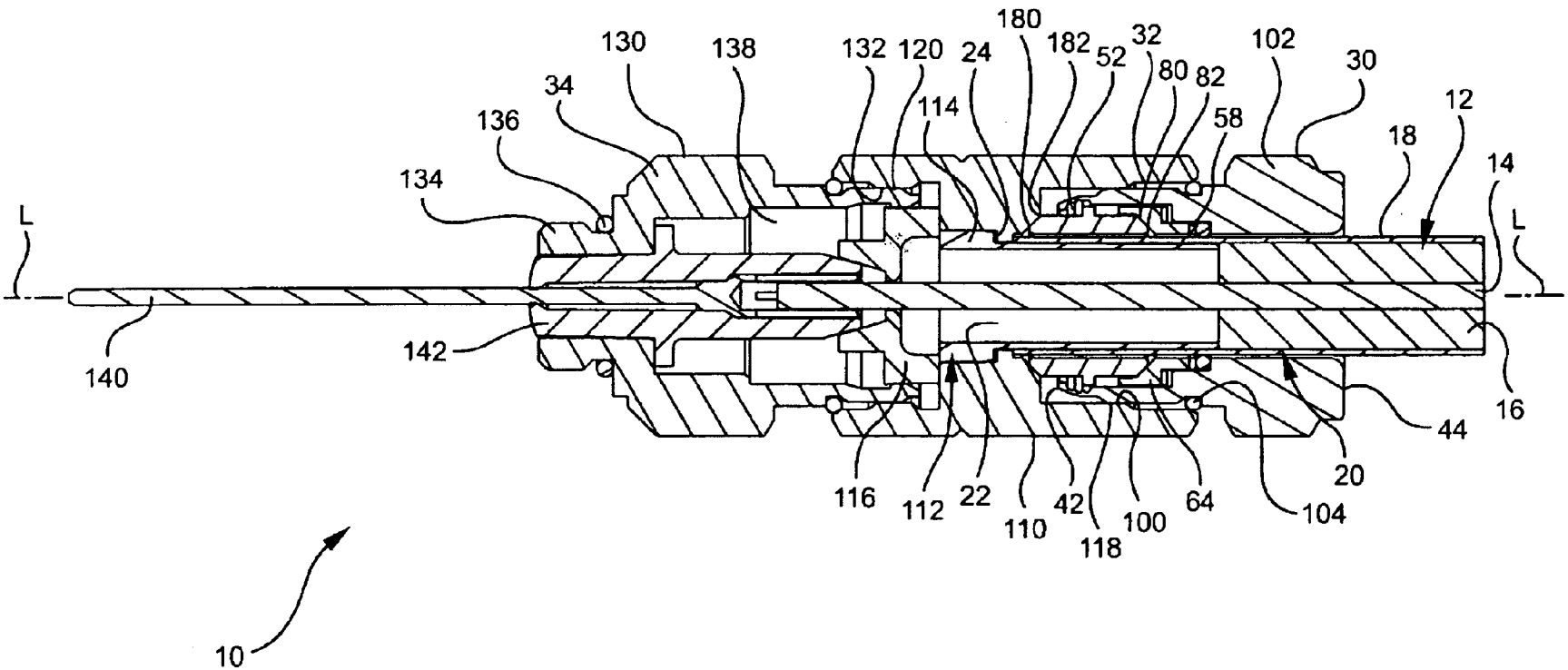
FIG. 1 is side cutaway view of a connector according to a presently preferred embodiment of one aspect of the invention. The connector comprises a cable gripping component according to another aspect of the invention, and is coupled to a coaxial cable.

Reference will now be made in detail to the presently preferred embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in this section in connection with the preferred embodiments and methods. The invention according to its various aspects is particularly pointed out and distinctly claimed in the attached claims read in view of this specification, and appropriate equivalents.

In accordance with one aspect of the invention, a connector is provided for a coaxial cable, for example, useful in connecting a coaxial cable to a terminal. The coaxial cable may be one of a number of types of coaxial cables known in the field. These may include, for example, flexible coaxial cable, commonly used, e.g., in interior applications such as cable television ("TV") and the like. In the presently preferred embodiments and implementations, the coaxial cable comprises a rigid cable having a center conductor, an insulating material (i.e., a core), and an outer conductor, typically without an outer insulator surrounding the outer conductor. Such coaxial cables are commonly used, for example, as trunk or distribution lines in cable TV systems and the like.

The coaxial cable comprises an exterior to which the connector typically would be fastened or secured. In the case of a flexible coaxial cable, for example, the exterior of the cable may comprise the outer insulator, the outer conductor, or both. In the case of a rigid cable as generally described above, the cable exterior may comprise the outer conductor.

Terminals with which such connectors may be used may include, for example, the end of another coaxial cable, a junction box, a transformer, or other electrical component.

A connector 10 according to presently preferred embodiment of this aspect of the invention is shown in FIG. 1. Although merely illustrative of this aspect of the invention, connector 10 preferably is designed for use with a rigid coaxial cable 12 having an inner conductor 14, a core insulator 16, and an outer conductor 18, e.g., as is used in trunk or distribution lines for cable TV and like applications. Connector 10 is adapted for use in coupling one end 20 of coaxial cable 12 to a terminal (not shown), such as one of those described above. A portion of the core insulator 16 at cable end 20 is removed, as generally indicated at 22. A portion of outer conductor 18 at cable end 20 also is removed, as generally indicated at 24, so that inner conductor 14 of cable 12 extends longitudinally beyond core insulator 16 and outer conductor 18. To illustrate spatial relationships with respect to this embodiment, connector 10 and cable 12 at its end 20 may be assumed to lie substantially along a longitudinal axis L which defines a longitudinal direction.

In accordance with this aspect of the invention, the connector comprises a cable gripping component. This cable gripping component, individually or in combination with other components, also comprises another aspect of the invention. The cable gripping component can provide a means for gripping the exterior of the coaxial cable. As implemented in connector 10 of the preferred embodiment, the cable gripping means comprises a cable gripping component in the form of a back nut assembly 30 and associated components as herein described, and equivalents of these. The connector according to this aspect of the invention further comprises a coupling component attached to a first end of the cable gripping component. In connector 10, back nut assembly 30 operates in conjunction with a coupling means or coupling component that comprises a main nut assembly 32 and a body assembly 34 and their associated components, and equivalents of these. The coupling component couples the connector to the terminal.

Figure 2:
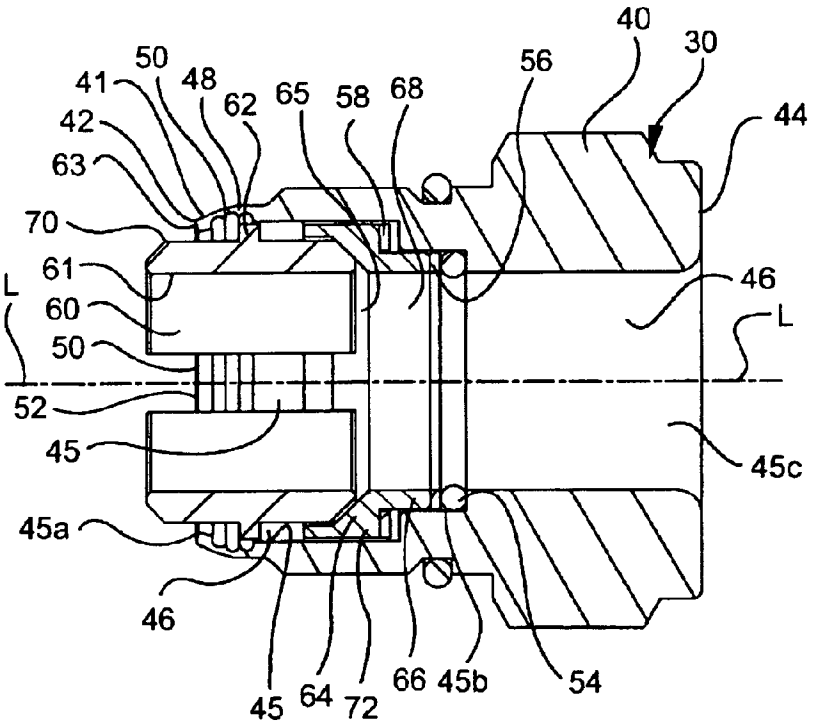
FIG. 2 shows a side cutaway view of a cable gripping component in the form of a back nut assembly for the preferred embodiment of FIG. 1, and according to another aspect of the invention.
Figure 5:
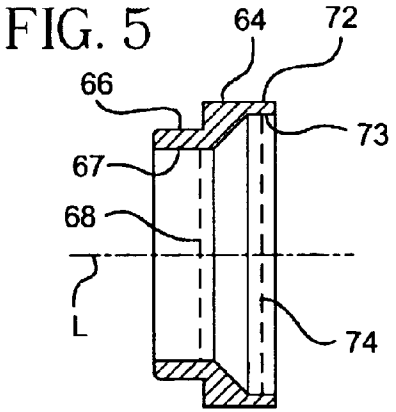
FIG. 5 shows a side cutaway view of the compression ring of FIG. 4 taken along line 5—5 of FIG. 4.
Figure 7:
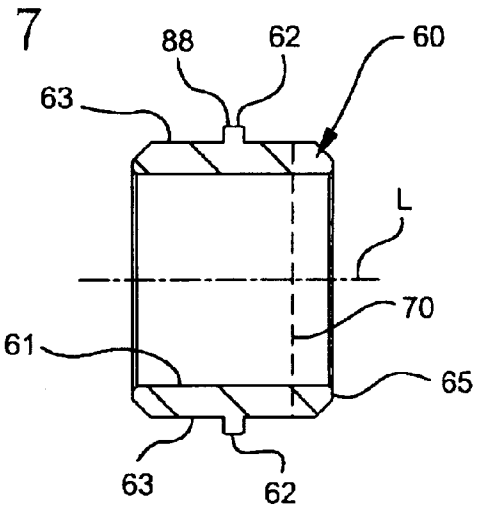
FIG. 7 shows a side cutaway view of the ferrule of FIG. 6, taken along line 7—7 of FIG. 6.
Figure 4:
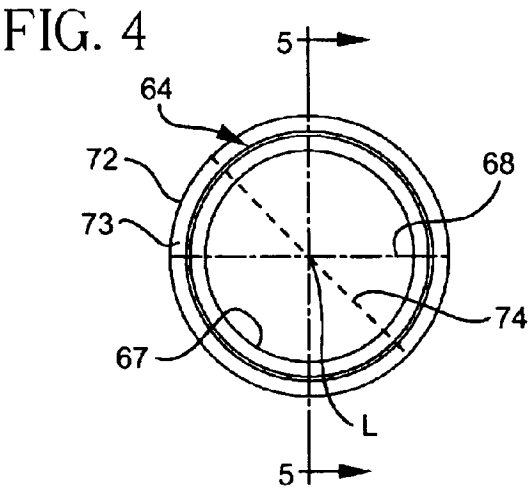
FIG. 4 shows an end view of the compression ring for the back nut assembly of FIG. 2.

Back nut assembly 30, shown separately in FIG. 2, comprises a is housing or back nut 40 including a sleeve portion 41 at a terminus 42 forming a first or proximal end of the housing 40. Terminus 42 would be positioned toward the terminal in relative terms. Housing 40 also includes a distal end 44 positioned away from the terminal and toward the remainder of cable 12 in relative terms. Back nut assembly housing 40 has an inner surface 45 defining an interior channel 46 extending to the proximal end 42 of back nut housing 40. The inner surface 45 of the back nut 40 comprises a proximal end inner surface portion 45*a*, an intermediate inner surface portion 45*b*, and a distal end inner surface portion 45*c*. The distal end inner surface 45*c* is sized and shaped to receive the coaxial cable 12. Sleeve portion 41 forms at least part of proximal end inner surface portion 45*a*.

Inner surface 45 of sleeve 41 comprises a retention surface disposed on the sleeve portion proximate the terminus. This sleeve portion includes a weakened area, wherein the retention surface is disposed between the terminus and the weakened area. This weakened area can provide a relatively predictable and controllable location for a bend in the sleeve 41 to aid in reducing the dimension of the inner surface 45 at the retention area and at terminus 42.

As specifically implemented in the presently preferred embodiment, inner surface 45 of back nut housing 40 includes a retention surface 52 disposed on sleeve portion 41 proximate terminus 42. A weakened portion or weakened area 48 is provided to facilitate bending of the sleeve portion 41 at that point. In one embodiment, the weakened portion is a region of thinner wall thickness relative to one or more adjacent wall thicknesses of the tubular wall of the sleeve portion 41. In another embodiment, the weakened portion comprises a tapered wall thickness. Preferably, the inner surface of sleeve portion 41 comprises at least one groove 50 disposed near or adjacent to proximal end 42, preferably at a predetermined longitudinal distance from terminus 42, of the back nut housing 40. The weakened area 48 in this instance preferably comprises a plurality of grooves, more preferably at least three grooves. Three grooves 50 are present in the embodiments illustrated in the FIGS. These grooves preferably are disposed immediately adjacent to one another. We have found that for one set of preferred embodiments, the removal of tubular wall material and/or absence of tubular wall material in the sleeve portion 41 to form one or more grooves can provide adequate structural strength and/or rigidity to the proximal end of the back nut 40 while also providing a weakened area which facilitates controlled radially inward bending during crimping of the sleeve portion 41.

Retention surface 52 in this embodiment is disposed at or near the proximal end or terminus 42 of the back nut assembly housing 40, and preferably adjacent to the proximal end 42 of back nut 40. Prior to assembly of the back nut assembly 30, the interior channel 46 at proximal end inner surface portion 45*a* preferably is cylindrical, including the portion comprising retention surface 52, as shown in FIG. 2. At the appropriate point during assembly of the back nut assembly 30, sleeve 41 is crimped, bent or otherwise moved radially inward toward longitudinal axis L, as exemplarily illustrated in FIG. 3.

Figure 3:
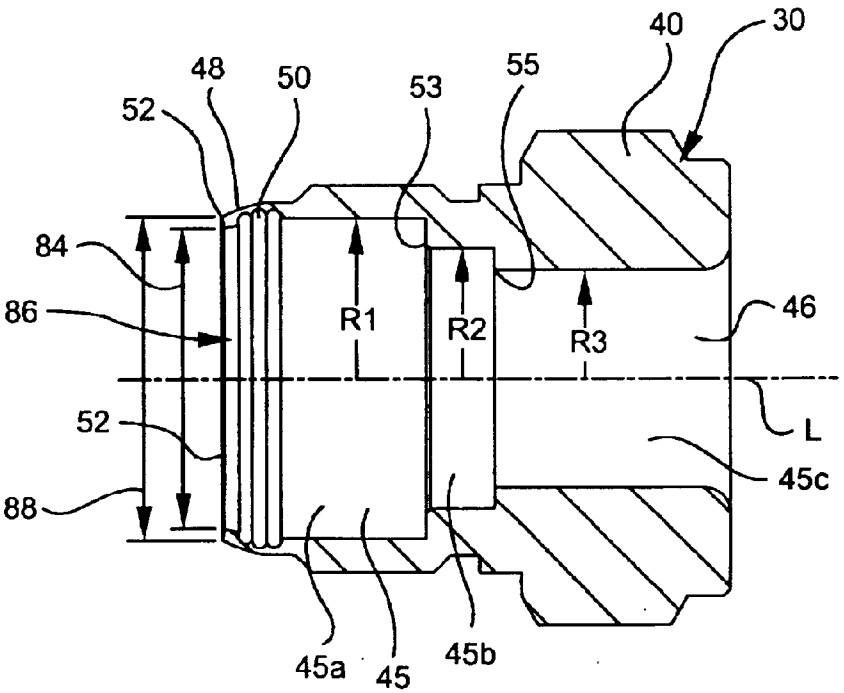
FIG. 3 shows a side cutaway view of the back nut assembly housing or back nut for the back nut assembly of FIG. 2.

Referring to FIG. 3, the proximal end inner surface portion 45*a* has a first radius R1 and the intermediate surface portion 45*b* has a second radius R2, wherein the first radius is greater than the second radius, and the surface portions 45*a* and 45*b* preferably together form a first shoulder 53. Distal end inner surface portion 45*c* has a third radius R3 wherein the second radius R2 is greater than the third radius R3, and the surface portions 45*b* and 45*c* preferably together form a second shoulder 55. Preferably at least part of surface portion 45*a* that includes the weakened portion 48 has a radius that is greater than the first radius R1. Preferably, an o-ring 54 is disposed on the intermediate inner surface portion 45*b*, preferably at or near the distal end of surface 45*b*, and more preferably at the second shoulder 55. Preferably a thrust washer 56 is disposed adjacent o-ring 54. A thrust washer 58 preferably is positioned on the proximal end inner surface portion 45*a*, preferably at or near the distal end of surface 45*a*, and more preferably at the first shoulder 53.

The connector according to this aspect of the invention, and the cable gripping component according to a related aspect of the invention, also comprise a ferrule disposed within the interior channel for contacting the coaxial cable. This contact typically will occur at the exterior of the cable, which in the illustrative embodiments would be at outer conductor 18. The ferrule comprises an outer surface that includes a raised portion. Interfering engagement between at least a portion of the retention surface and the raised portion prevents at least a portion of the ferrule from exiting the interior channel.

Figure 6:
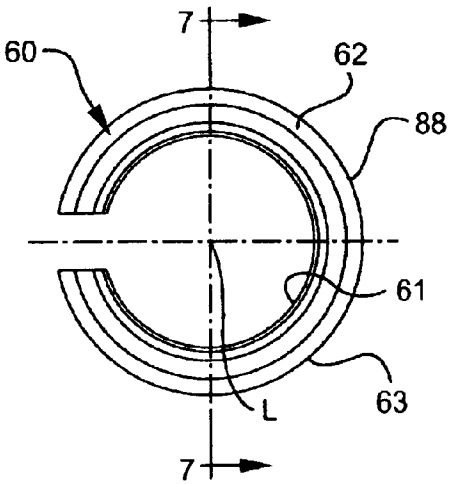
FIG. 6 shows an end view of the ferrule for the back nut assembly of FIG. 2.

As implemented in the embodiments shown in the FIGS, a ferrule 60 is disposed within the interior channel 46. Ferrule 60 has an inner surface 61 for contacting the exterior of the coaxial cable at outer conductor 18. FIG. 6 shows an end view of one embodiment of a ferrule 60 according to the preferred embodiment. Ferrule 60 is generally C-shaped so as to be capable of being compressed about or with respect to longitudinal axis L. Ferrule 60 includes an outer surface 63 from which extends a raised portion, here in the form of an outer flange 62. With this arrangement, ferrule 60 is retained in the interior channel 46 by retention surface 52 interferingly engaging outer flange 62. Ferrule 60 in this embodiment has an axial or longitudinal dimension selected so that a portion of ferrule 60, e.g., its proximal terminal end or terminus, extends beyond the sleeve 41 and beyond back nut assembly housing terminus 42 after the sleeve has been crimped radially inwardly to reduce the diameter of housing terminus 42 to be smaller than that of ferrule flange 62. This arrangement also can permit ferrule 60 to be loosely and rotatably held within interior channel 46 when back nut assembly 30 is in an "uncoupled" state, i.e., when back nut assembly 30 has not yet been firmly coupled to the coupling component, e.g., main nut assembly 32.

A compression ring 64 is disposed within interior channel 46 between ferrule 60 and inner surface 45 of housing 40, at the distal end 65 of ferrule 60. Compression ring 64 comprises a first annular portion 66 having a first inner surface 67 with first inner diameter 68 smaller than an outer diameter 70 of ferrule 60, e.g., so that compression ring 64 is capable of interferingly engaging ferrule 60 and compressing ferrule 60 as the compression ring 64 and the ferrule 60 are driven axially toward one another. Compression ring 64 also comprises a second annular portion 72 having a second inner surface 73 with a second inner diameter 74 larger than outer diameter 70 of ferrule 60, e.g., to aid in maintaining ferrule 60 in longitudinal alignment within interior channel 46. Ferrule 60 preferably is at least partially disposed within the second annular portion 72 of compression ring 64, so that at least a portion of the inner surface 73 of the second annular portion 72 of the compression ring 64 contacts the outer surface 70 of ferrule 60. Preferably, ferrule 60 comprises a beveled mating inner surface 80 and compression ring 64 comprises a corresponding beveled mating outer surface 82 for mating with the beveled mating surface 80 of ferrule 60. Referring to FIG. 2, the beveled mating inner surface 80 is disposed between the first inner surface of the first annular portion 66 and the second inner surface of the second annular portion 72. Axial movement (along longitudinal axis L) of the compression ring 64 and ferrule 60 toward one another causes engagement of the mating surfaces 80 and 82 and causes the ferrule 60 to compress radially inwardly toward longitudinal axis L. The bevel on the mating surfaces 80 and 82 can help to avoid point loading between the compression ring 64 and ferrule 60.

Retention surface 52 retains the ferrule 60 in position within the interior channel 46 of housing 40 when the back nut assembly 30 is in an uncoupled state, e.g., when back nut assembly 30 is not coupled to and engaged with main nut 32. As shown in FIG. 2, when initially manufactured, the portion of the interior channel 46 formed by proximal end 42 of sleeve 41, including the portion comprising grooves 50 and retention surface 52, is substantially cylindrical, allowing compression ring 64 and ferrule 60 to be inserted into the interior channel 46 through proximal end 42 of back nut assembly housing 40. The proximal end 42 of housing 40 then may be crimped, bent, or otherwise moved, preferably substantially radially inwardly toward interior channel 46, so that retention surface 52 moves toward longitudinal axis L to a point at which the diameter. 84 (FIG. 3) of the opening 86 formed by retention surface 52 is smaller than the ferrule outer diameter 88 at ferrule flange 62. The weakened area 48, shown provided by grooves 50 in this embodiment, permits the proximal end 42 of the back nut assembly housing 40 to bend at a predetermined location, i.e., at the weakened area, so that the retention surface 52 can be moved into the desired location to secure the ferrule 60 easily and reliably within interior channel 46. Thus, the back nut assembly 30 securely retains the ferrule 60 generally in position, even when the back nut assembly exists as an individual component prior to coupling it with main nut assembly 32 or its equivalent. This arrangement also permits ferrule 60, prior to coupling back nut assembly 30 with the main nut assembly 32 or its equivalent, to fit loosely within the interior channel 46, and to rotate within the interior channel. This can be advantageous, for example, in facilitating the coupling of the back nut assembly onto the coaxial cable, and the coupling of the main nut assembly or its equivalent to the back nut assembly while the latter is affixed to the coaxial cable.

Figure 8:
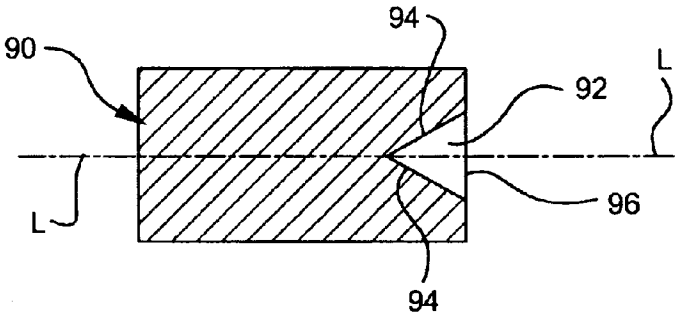
FIG. 8 shows a side cutaway view of a presently preferred embodiment of a tool for use in modifying the proximal end of the back nut assembly housing to retain the ferrule during an uncoupled state of the connector of FIG. 1.
Figure 9:
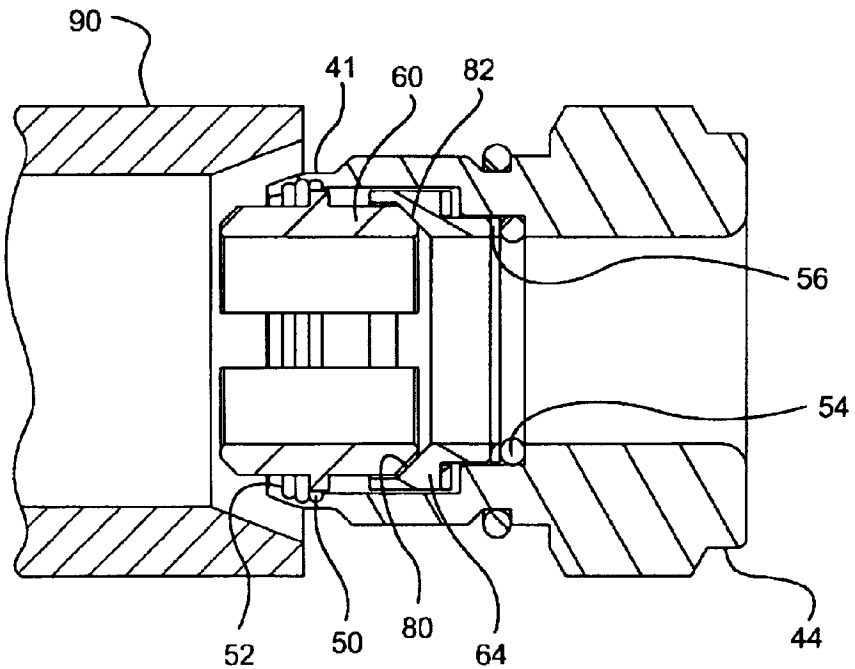
FIG. 9 shows a side cutaway view of the back nut assembly of FIG. 2 with the tool of FIG. 8 in position to modify the proximal end of the back nut assembly.

With reference to FIGS. 8 and 9, bending of the proximal end 42 of back nut assembly housing 40 is preferably accomplished by using a tool 90. Tool 90 comprises a concavity 92 formed by a distal surface 94 extending circumferentially around its distal base 96 and preferably angled or curved with respect to longitudinal axis L such that, when forced longitudinally and distally toward back nut assembly housing 40, surface 94 contacts the outer portion of peripheral end 42 of housing 40 and forces a bend at weakened area 48, urging retention surface 52 inward radially toward longitudinal axis L to create narrowed diameter 84. Application of the force and consequent deformation are continued until retention surface 52 is at the desired location, e.g., as shown in FIGS. 1 and 3. The angle or curve of the surface 94 may be selected as is appropriate to obtain the desired shape of the retention surface 52. Surface 94 may, for example, be conical in shape, curved, parabolic, etc. Preferably but optionally, surface 94 is substantially conical with an angle with respect to the longitudinal axis L, e.g., of approximately 45 degrees.

The outer surface of back nut 40 includes threads 100 and preferably includes a head configuration 102, such as a hex or octagonal head, suitable for engaging a device such as a wrench for rotating back nut assembly 30 to engage or disengage threads 100. Back nut assembly 30 also preferably comprises an external o-ring 104, for environmental sealing, disposed on the outer surface of back nut 40.

Advantageously, the proximal portion of ferrule 60 extending proximately from sleeve terminus 41 is sized and configured to abut and frictionally engage a surface on a mating component such as the terminal coupling component. Thus, as the cable gripping component is urged toward the coupling component to be coupled together, the extending portion of the ferrule abuts the coupling component and rotation of the ferrule with respect to the coupling component is at least partially inhibited. This can reduce the amount of twist imparted to the cable as the housing 40 is rotated with respect to the coupling component and as ferrule 60 is compressed against the cable.

Figure 10:
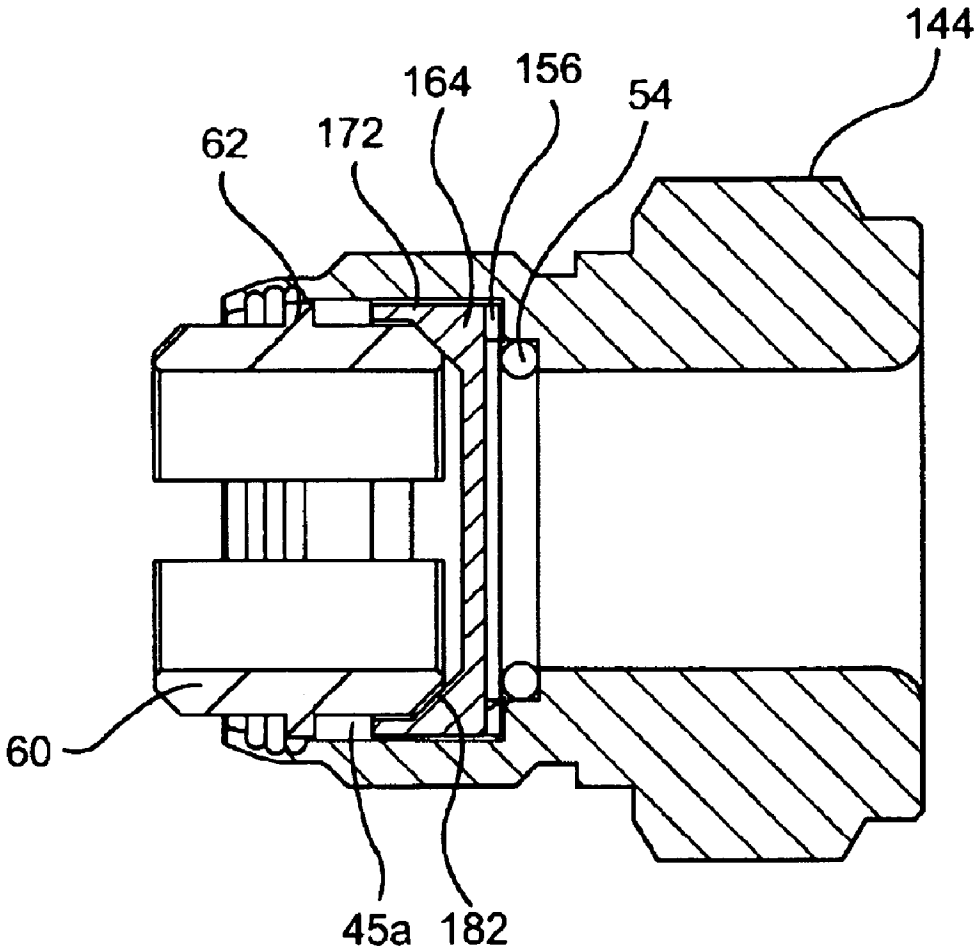
FIG. 10 shows a side cutaway view of a back nut assembly according to a second preferred embodiment of the invention.
Figure 11:
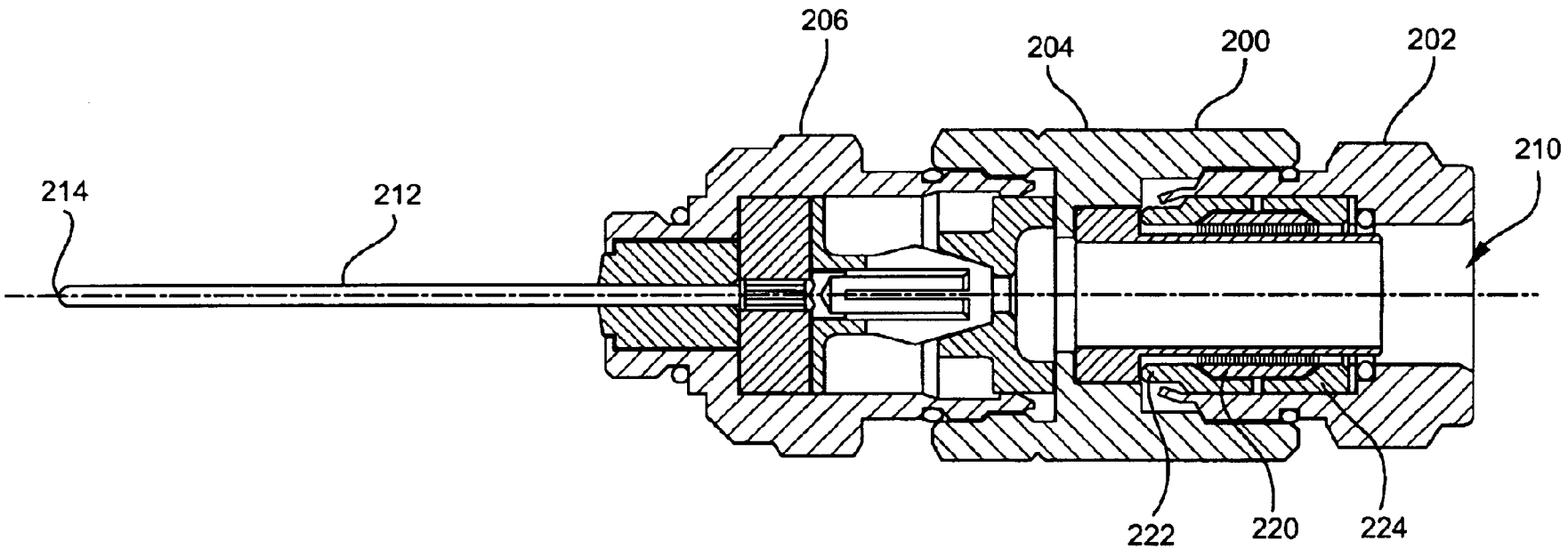
FIG. 11 PRIOR ART
FIG. 11 shows a connector according to a prior art design.

Back nut assembly 30 may comprise component designs other than those shown and described herein above. For example, another embodiment of a compression ring 164 is illustrated in FIG. 10. Compression ring 164 comprises a annular portion 172 with beveled surface 182. In contrast to compression ring 64, the annular portion 66 could be reduced or eliminated, where, for example, a single thrust washer 156 could be utilized between the compression ring 164 and o-ring 54.

The connector according to this aspect of the invention further comprises a coupling component attached to the first end of the cable gripping component. The coupling component comprises a device, component, or assembly capable of coupling to or with the cable gripping means or component, and capable of being coupled to the terminal. The coupling component as implemented in the presently preferred embodiment comprises main nut assembly 32 and body assembly 34.

Main nut assembly 32 comprises a main nut housing 110. Housing 110 comprises an inner surface 111 defining a central cavity 112. A sleeve 114 is inserted into the end 20 of coaxial cable 12, and sleeve 114 in turn resides in cavity 112 of housing 110. Sleeve 114 can be configured and adjusted to tune the connector so that its performance can be optimized for the specific application, signal, etc., in a manner known in the art. A resilient positioning component 116 is positioned at the proximal end of sleeve 114 and cavity 112. Resilient positioning component 116, which preferably comprises an acetyl material or like substance, can be used to radially position and stabilize the proximal end of inner conductor 14 of cable 12.

Main nut assembly 32 preferably comprises a distal fastener means in the form of a distal fastener for fastening to the first or proximal end of the cable gripping means or component housing. The specific design of distal fastener will depend on the design employed for the coupling portion of main nut assembly, or of the corresponding coupling component if a main nut assembly is omitted. In the embodiment of the connector 10 shown in the Figures, main nut housing 110 comprises distal fastening means comprising threads 118 at or near its distal end for engaging threads 100 of back nut assembly housing 40. Main nut assembly 32 further comprises fastening means such as threads 120 at its proximal end. Means also are provided, for example, in the form of a hex or octagonal external head or surface configuration, for fastening or engaging main nut assembly 32 to back nut assembly 30 and body assembly 34. This preferably enables one to rotate the assemblies with respect to one another so they are threadably engaged.

Body assembly 34 comprises a body assembly housing 130 which mates with and threadably engages the proximal end of main nut assembly 32. Fastening means such as threads 132 are provided at the distal end of body assembly housing 130 to engage threads 120 of main nut assembly. Body assembly 34 also preferably comprises a proximal fastener means or a proximal fastener for fastening to the terminal. The proximal fastener will depend upon the specific application, the specific terminal or terminal type, etc. In the embodiment disclosed herein, the proximal fastener comprises threads 134. Appropriate environmental sealing means, such as o-rings 136, also may be included at the threaded joints or engagements.

Body assembly housing 130, comprises a cavity 138 disposed about longitudinal axis L. The proximal end of inner conductor 14 extends through an aperture in positioning component 116 and into cavity 138. A conductive pin 140 is disposed over this proximal end of conductor 14 to continue a conduction path through the proximal end of body assembly 34. An insulative actuator 142 is disposed in cavity 138 to receive and guide pin 140. Actuator 142 in this preferred embodiment comprises an injection molded plastic material, for example, ULTEM 1000, commercially available from General Electric Plastics Co. of Pittsfield, Mass.

In the presently preferred embodiments, the ferrule 60 is disposed such that it contacts the coupling component, and preferably the compression ring 64 does not contact the coupling component. It also is preferable that the ferrule and the coupling component have mutually mating beveled surfaces. In the illustrative embodiment of FIG. 1, for example, ferrule 60 includes a bevel 180 on its proximal end, and a bevel 182 is provided on a surface in the interior or main nut housing 110. Bevels 180 and 182 are configured to mate with one another so that, as back nut assembly 30 and main nut assembly 32 are coupled and thus drawn together axially, these beveled surfaces contact one another and thereby force ferrule 60 onto outer conduct 18 of coaxial cable 12. Preferably but optionally, these beveled surfaces 180 and 182 correspond in size, shape, angle, etc. with beveled surfaces 80 and 82 of the ferrule and compression ring, respectively, for example, to balance the forces on ferrule 60 and urge the ferrule substantially symmetrically onto the cable exterior.

In accordance with additional aspects of the invention, methods are provided for providing a cable gripping component, and for connecting a coaxial cable. These methods preferably are practiced in connection with coupling a coaxial cable to a terminal. To better illustrate these methods and for ease of illustration, preferred versions will be described with reference to the presently preferred embodiments of the invention as described herein above, although they are not necessarily limited to such embodiments.

The method for providing a cable gripping component according to this aspect of the invention comprises providing a cable gripping housing including a sleeve portion having a terminus forming a first end of the housing. The housing has an inner surface defining an interior channel. The inner surface comprises a retention surface disposed on the sleeve portion proximate the terminus. The sleeve portion includes a weakened area, e.g., preferably comprising at least one groove, wherein the retention surface is disposed between the terminus and the weakened area. In this illustrative version of the method, each of these components is as described above with respect to back nut assembly 30.

The method according to this aspect of the invention further comprises providing a ferrule comprising an outer surface that includes a raised portion, and inserting the ferrule into the interior channel. The presently preferred implementation of this method comprises providing ferrule 60 as described herein above. The method optionally but preferably comprises positioning a compression ring, and more preferably a compression ring such as compression ring 64, in the interior channel distally with respect to the ferrule.

The method further comprises moving the retention surface, e.g., crimping the sleeve portion, inwardly toward the ferrule or the longitudinal axis so that the interfering engagement is provided between at least a portion of the retention surface and the raised portion. In the preferred implementation, weakened area 48 of sleeve 41 permits retention surface 52 to constrict, thereby retaining ferrule 60 in the interior channel of the cable gripping component housing by the retention surface and the raised portion of the outer surface of the ferrule. In the presently preferred implementation of the method, this comprises bending or otherwise moving retention surface 52 radially inward toward longitudinal axis L so that it retains ferrule 60 in proximal end cavity 45*a*. As noted above, it is preferred that a plurality of grooves are used, preferably disposed immediately adjacent to one another. It is also preferable that at least three grooves be used. The retention surface preferably is moved using a tool to compress the proximal surface of the cable gripping component housing and to move the retention surface, such as tool 90 as shown in FIGS. 8 and 9. In this manner, at least a portion of the ferrule, e.g., its proximal end, is prevented from exiting the interior channel. This method also may yield a cable gripping component in which, when uncoupled with respect to the a coupling component, e.g., such as main nut assembly 32 and its equivalents (e.g., in an uncoupled state), the ferrule is capable of rotating within the interior channel.

When moving the retention surface to a position in which it retains the ferrule, it is preferable that the retention surface be bent or moved so that the proximal end interior channel 46 comprises a distal portion, e.g., distally with respect to grooves 50, having a first substantially cylindrical cross section, and a proximal portion, e.g., at retention surface 52, having a second cross section different from, and smaller than, the first cross section. In other words, the portion of sleeve 41 This bending or moving of the proximal end of the back nut assembly housing 40 preferably causes the second cross section, e.g., at the retention surface, that comprises a conical cross section, a parabolic cross section, or a curved cross section.

The method for connecting a coaxial cable comprises fastening the coupling component to the terminal using a proximal fastener for fastening to the terminal. This may be accomplished by fastening the connector 10, comprising the assembled components of back nut assembly 30, main nut assembly 32 and body assembly 34 as shown in FIG. 1, to the terminal, for example, using threads 134.

In accordance with the presently preferred implementation of the method, once assembled, the back nut assembly 30 can be used as follows. The coaxial cable 12 is prepared as described herein above, e.g., by removing the proximal portions of the core insulator 16 and the outer conductor 18. Back nut assembly 30 then is placed over the proximal end of cable 12.

The method for connecting a coaxial cable, in addition to providing a cable gripping component as described herein above, also preferably comprises providing a coupling component and attaching the coupling component to the first end of the gripping component to a coupling component, preferably at a distal to fastener of the coupling component. The presently preferred implementation of this aspect of the method comprises coupling back nut assembly 30 to main nut assembly 32 and body assembly 34.

In accordance with the preferred implementation of this method, the coaxial cable is coupled to the terminal, e.g., such as an equipment port, as follows. Body assembly 34 is threadably engaged with and tightened to the terminal using threads 134. Sleeve 114 is inserted into proximal end 20 of cable 12. Coaxial cable 12 is passed through the cavity of main nut assembly 32, and center or inner conductor 14 is inserted into pin 140. The main nut assembly 32 then is threadably engaged with and tightened onto body 34. Back nut assembly 30 is then threadably engaged with and tightened onto main nut assembly 32 to tighten threads 100 of back nut assembly 30 and mating threads 118 of main nut assembly 32. As they are tightened, bevels 80 and 82 engage, as eventually do bevels 180 on the proximal end of ferrule 60 and 182 in main nut assembly cavity 112, to urge ferrule 60 into intimate and gripping contact with the external portion of the cable 12, which in this preferred but illustrative embodiment comprises outer conductor 18.

Preferred embodiments and preferred versions of the methods according to the invention can be advantageous, for example, in that use of the arrangement as described herein can permit the ferrule to be attached to and retained with the cable gripping device when in component form, i.e., prior to coupling of the cable gripping device to the coupling component. These aspects of the invention also may be beneficial, for example, in permitting connection of a coaxial cable to a terminal while limiting or eliminating undesirable twisting of and torsion on the cable. The use of a compression ring as described herein also facilitates connector performance by better maintaining the alignment of components, and better facilitating contacting of the ferrule with the cable exterior. The elimination of a proximal compression ring as described herein with respect to the presently preferred embodiments also allows the back nut assembly 30 to be tightened with respect to the main nut assembly while limiting or preventing twisting on the inner conductor 14, the outer conductor 18, or other components. of the cable as the connector is being attached to the cable.

Additional advantages and modifications will readily occur to those skilled in the art. For example, the cable gripping component is described herein as an integral component of the connector and, with respect to presently preferred connector 10, as a component of the connector. The cable gripping component, however, independently of connector 10, comprises another aspect of the invention. In addition, the preferred embodiments and methods have been described using a particular type of coaxial cable having no outer insulator or jacket. It will be understood by those in the art, however, that the invention is not necessarily limited to such limited applications. Furthermore, the order in which steps of the inventor and its preferred implementations are performed may be varied. Therefore, the invention in its broader aspects is not limited to the specific details, representative devices and methods, and illustrative examples shown and described. Accordingly, departures may be made from such details without departing from the spirit or scope of the general inventive concept as defined by the appended claims and their equivalents.

What is claimed is:

1. A cable gripping component for gripping a coaxial cable, the cable gripping component comprising:

a housing including a sleeve portion having a terminus forming a first end of the housing, the housing having an inner surface defining an interior channel, the inner surface comprising a retention surface disposed on the sleeve portion proximate the terminus, the sleeve portion including a weakened area, wherein the retention surface is disposed between the terminus and the weakened area; and a ferrule disposed within the interior channel for contacting the coaxial cable, the ferrule comprising an outer surface that includes a raised portion, wherein the ferrule extends beyond the terminus of the housing and wherein the ferrule is capable of being compressed against the coaxial cable, and wherein interfering engagement between at least a portion of the retention surface and the raised portion prevents at least a portion of the ferrule from exiting the interior channel.

2. The cable gripping component as recited in claim 1, wherein the ferrule has a terminus that extends beyond the terminus of the housing.

3. The cable gripping component as recited in claim 1, wherein the ferrule is loosely held within the interior channel.

4. The cable gripping component as recited in claim 1, wherein the weakened area comprises at least one groove.

5. The cable gripping component as recited in claim 4, wherein the at least one groove is disposed on the inner surface of the sleeve portion.

6. The cable gripping component as recited in claim 4, wherein the at least one groove comprises a plurality of grooves.

7. The cable gripping component as recited in claim 1, further comprising a compression ring disposed within the interior channel between the ferrule and the inner surface of the housing.

8. The cable gripping component as recited in claim 7, wherein:

the ferrule comprises a beveled mating surface; and the compression ring comprises a beveled mating surface for mating with the beveled mating surface of the ferrule.

9. A connector for a coaxial cable, the connector comprising:

a cable gripping component comprising a cable gripping component housing including a sleeve portion having a terminus forming a first end of the housing, the housing having an inner surface defining an interior channel, the inner surface comprising a retention surface disposed on the sleeve portion proximate the terminus, the sleeve portion including a weakened area, wherein the retention surface is disposed between the terminus and the weakened area, the cable gripping component further comprising a ferrule disposed within the interior channel for contacting the coaxial cable, the ferrule comprising an outer surface that includes a raised portion, wherein interfering engagement between at least a portion of the retention surface and the raised portion prevents at least a portion of the ferrule from exiting the interior channel; and a coupling component attached to the first end of the cable gripping component.

10. The connector as recited in claim 9, wherein the ferrule contacts the coupling component.

11. The connector as recited in claim 9, wherein the cable gripping component further comprises a compression ring disposed within the interior channel between the cable gripping component housing and the ferrule.

12. The connector as recited in claim 9, wherein the compression ring does not contact the coupling component.

13. The connector as recited in claim 9, wherein the ferrule and the coupling component have mutually mating beveled surfaces.

14. A method for assembling a cable gripping component for a coaxial cable, the method comprising:

providing a cable gripping component housing including a sleeve portion having a terminus forming a first end of the housing, the housing having an inner surface defining an interior channel, the inner surface comprising a retention surface disposed on the sleeve portion proximate the terminus, the sleeve portion including a weakened area, wherein the retention surface is disposed between the terminus and the weakened area;

providing a ferrule comprising an outer surface that includes a raised portion;

inserting the ferrule into the interior channel;

crimping the sleeve portion to provide interfering engagement between at least a portion of the retention surface and the raised portion, whereby at least a portion of the ferrule is prevented from exiting the interior channel; and providing a coupling component and attaching the coupling component to the first end of the cable gripping component.

15. The method of claim 14, wherein the ferrule insertion comprises inserting the ferrule into the interior channel so that the ferrule is capable of rotating within the interior channel.

16. A method for attaching a connector to a coaxial cable, the method comprising:

providing a cable gripping component for a coaxial cable, wherein the cable gripping component comprises a cable gripping component housing including a sleeve portion having a terminus forming a first end of the housing, the housing having an inner surface defining an interior channel, the inner surface comprising a retention surface disposed on the sleeve portion proximate the terminus, the sleeve portion including a weakened area, wherein the retention surface is disposed between the terminus and the weakened area, the cable gripping component further comprises a ferrule disposed in an interior channel of the housing, the ferrule comprising an outer surface that includes a raised portion, wherein the inner surface narrows from the weakened area to the retention area and at least a portion of the ferrule is prevented from exiting the interior channel by the retention surface and the raised portion of the ferrule outer surface;

positioning the cable gripping component on the coaxial cable so that the ferrule contacts the coaxial cable; and providing a coupling component and attaching the coupling component to the first end of the cable gripping component.

17. A method as recited in claim 16, further comprising providing a compression ring within the cable gripping component to contact the ferrule.

18. A cable gripping component for gripping a coaxial cable, the cable gripping component comprising:

a housing including a sleeve portion having a terminus forming a first end of the housing, the housing having an inner surface defining an interior channel, the inner surface comprising a retention surface disposed on the sleeve portion proximate the terminus, the sleeve portion including a weakened area, the weakened area comprising a plurality of grooves, wherein the retention surface is disposed between the terminus and the weakened area; and a ferrule disposed within the interior channel for contacting the coaxial cable, the ferrule comprising an outer surface that includes a raised portion;

wherein interfering engagement between at least a portion of the retention surface and the raised portion prevents at least a portion of the ferrule from exiting the interior channel.

19. A cable gripping component for gripping a coaxial cable, the cable gripping component comprising:

a housing including a sleeve portion having a terminus forming a first end of the housing, the housing having an inner surface defining an interior channel, the inner surface comprising a retention surface disposed on the sleeve portion proximate the terminus, the sleeve portion including a weakened area, wherein the retention surface is disposed between the terminus and the weakened area;

a ferrule disposed within the interior channel for contacting the coaxial cable, the ferrule comprising an outer surface that includes a raised portion; and a compression ring disposed within the interior channel between the ferrule and the inner surface of the housing;

wherein interfering engagement between at least a portion of the retention surface and the raised portion prevents at least a portion of the ferrule from exiting the interior channel.

20. The cable gripping component as recited in claim 19, wherein:

the ferrule comprises a beveled mating surface; and the compression ring comprises a beveled mating surface for mating with the beveled mating surface of the ferrule.

* * * * *